United States Patent [19]

Adolph

[11] Patent Number: 4,654,486

[45] Date of Patent: Mar. 31, 1987

[54] POOR-SCATTER POT MAGNET SYSTEM FOR MAGNETIC-DYNAMIC LOUDSPEAKERS OR ACOUSTIC TRANSDUCERS

[76] Inventor: Kurt Adolph, Koenigswinterer Str. 378, D-5300 Bonn-Beuel, Fed. Rep. of Germany

[21] Appl. No.: 664,026

[22] Filed: Oct. 23, 1984

[30] Foreign Application Priority Data

Nov. 3, 1983 [DE] Fed. Rep. of Germany ..... 3339720

[51] Int. Cl.[4] ..... H04R 9/02; H04R 9/04

[52] U.S. Cl. ..... 381/201; 335/301; 335/304; 381/189

[58] Field of Search ..... 179/119 R, 117, 114 M, 179/115.5 R, 115.5 PC, 115.5 SF, 115.5 ES, 120, 114 R; 335/231, 304, 301

[56] References Cited

U.S. PATENT DOCUMENTS 3,067,366 12/1962 Hofman ..... 179/117
4,465,906 8/1984 Adolph et al. ..... 179/119 R

FOREIGN PATENT DOCUMENTS 2845694 4/1980 Fed. Rep. of Germany ... 179/115.5 R
3,150,041 6/1983 Fed. Rep. of Germany ... 179/115.5 R
55-118299 9/1980 Japan ..... 179/115.5 SF
57-52298 3/1982 Japan ..... 179/115.5 R
1530286 10/1978 United Kingdom ..... 179/115.5 R

OTHER PUBLICATIONS

DIN 45578 (the German Standardization Institute Paper entitled: "Magnet System for Moving Coil Loudspeakers: Definitions, Dimensions, Methods of Measurement").

*Primary Examiner*—Gene Z. Rubinson
*Assistant Examiner*—Danita R. Byrd
*Attorney, Agent, or Firm*—Fisher, Christen & Sabol

[57] ABSTRACT

A poor-scatter pot magnet system for magnetic-dynamic loudspeakers or acoustic transducers in which two permanent magnets, of which at least the upper one is a magnet ring. A pole core, an upper, perforated plate and a lower pole plate are built into an iron pot coaxially to one another in such a way that the pole core penetrates the upper magnet ring and the upper, perforated pole plate in a central opening. The upper edge of the iron pot ends in the area of the side of the upper magnet ring below the top thereof.

2 Claims, 1 Drawing Figure

POOR-SCATTER POT MAGNET SYSTEM FOR MAGNETIC-DYNAMIC LOUDSPEAKERS OR ACOUSTIC TRANSDUCERS

BACKGROUND OF THE INVENTION

The invention relates to a poor-scatter pot magnet system for magnetic-dynamic loudspeakers or acoustic transducers.

Poor-scatter magnet systems have already been customary for building into television receivers or for a use in the vicinity of ferrite antennas. At the same time, always two permanent magnets (ring and plate) are built into a completely closed iron pot which, with its upper edge, encloses nearly the upper pole plate of the magnet system. As a result of the fact that the magnet ring and the magnet plate are magnetized in an opposite direction and the magnetic system is completely screened off as a result of the potshaped housing, there results hitherto already a decrease of the magnetic scattering effect which, in the case of most types in a measuring distance according to DIN 45 578 (the German Standardization Institute paper entitled: "Magnet System For Moving Coil Loudspeakers: definitions, dimensions, methods of measurement) of 100 mm from the pole core center amounts to less than 1 A/cm. The unit A/cm is Amperes/centimeter, a unit of a magnetic field H in the International System of units. For this type of measurement, formerly the "Oersted" was used. Such magnetic systems poor in scattering are therefore used particularly in television devices in the case of which the magnetic scatter field would lead to the distortion of the television picture on the picture tube.

As a result of the continuously progressing development in the field of television and radio engineering, television devices nowadays are however no longer equipped with only one but with several loudspeakers so that the space available in the housing of the television devices becomes ever tighter. The loudspeaker magnets move more closely to the picture tube so that the magnetic scattering of the known loudspeaker system becomes evermore problematic.

SUMMARY OF THE INVENTION

Therefore, the present invention is based on the task of achieving with simple technical means a further decrease of the magnetic scatter field directed to the outside of such pot magnet systems.

In the case of a poor-scatter pot magnet system, this task will be solved according to the invention in a surprisingly simple manner through the fact that the upper edge of the iron pot ends already in the area of the ring level of the upper magnetic ring. As measurements according to DIN 45 578 have shown, an additional considerable decrease of the magnetic scattering of such magnetic systems up to about 0.5 A/cm at a measuring distance of 100 mm from the pole core center may be achieved by the measure according to the invention.

DETAILED DESCRIPTION OF THE INVENTION

Figure 1:
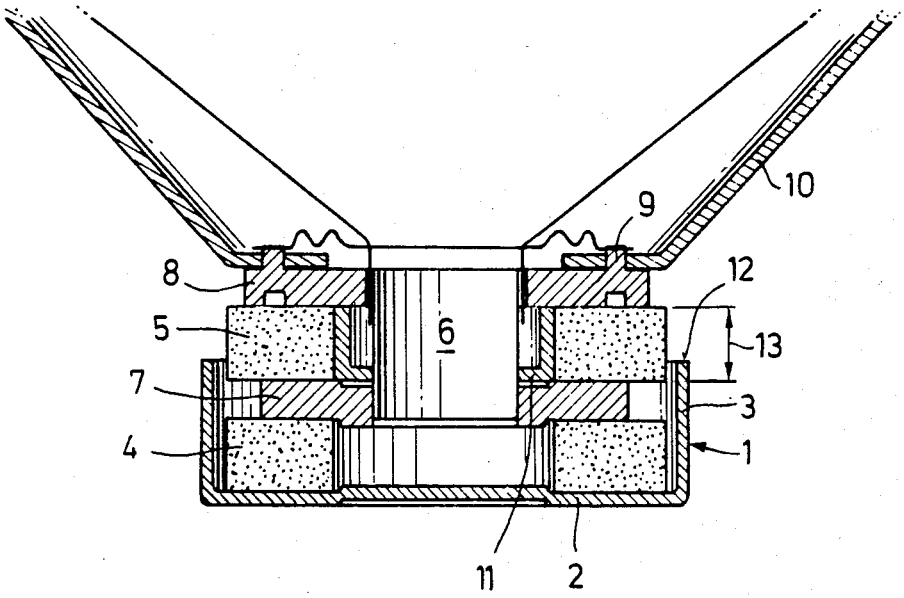
FIG. 1 is the invention shown in sectional view, of a pot magnet system for magnetic-dynamic loudspeakers or for acoustic transducers.

In an iron pot with a bottom 2 and pulled up cylindrical pot wall 3, two permanent magnets 4, 5, a lower pole plate 7 with pole core 6 and an upper pole plate 8 are disposed coaxially in relation to one another. From the upper pole plate 8 upwards, rivet slugs 9 are pushed out for the securing of a membrane holder 10.

Both permanent magnets 4, 5 are developed as magnetic rings and the pole core 6 projects from the lower pole plate 7 in a known manner through the opening of the upper magnet ring 5 up into the central hole of the upper pole plate 8 coaxially. Moreover, a protective cap 11 against dust is inserted into the opening of the upper magnet ring.

As can be recognized furthermore from the drawing, the entire magnetic system is attached at the bottom 2 of the iron pot 1, and the iron pot 1 has only such a slight height that the upper edge 12 of the iron pot 1 terminates in the area of the height 13 of the ring of the upper magnet ring 5.

The improved magnet system of the present invention results in a decrease of magnetic scatter effect to about 0.5 A/cm, which is acheived at a measuring distance of 100 mm from the pole core center, according to standard DIN 45 578.

The improved magnet system of the present invention is capable of achieving the above-enumerated objective and while a preferred embodiment of the invention has been disclosed, it will be understood that it is not limited thereto but may be otherwise embodied within the scope of the following claims.

What is claimed is:

1. A poor scatter pot magnet system for magnetic-dynamic loudspeakers having upper and lower permanent magnets wherein at least said upper magnet is an upper magnet ring; a pole core; an upper perforated pole plate; a lower pole plate; and a cylindrical iron pot having a cylindrical wall; said magnets, said pole core, and said pole plate being built into said cylindrical iron pot coaxially into one another in such a way that said pole core extends through said upper magnet ring and said perforated pole plate; and said cylindrical iron pot wall terminating in a planar upper edge in the area of the side of said upper magnet ring below the top thereof.

2. The magnet system as claimed in claim 1, wherein the second of said two permanent magnets is a magnetic ring.

* * * * *